United States Patent [19]

Dumas et al.

[11] 4,031,615

[45] June 28, 1977

[54] METHOD OF MAKING CATHODES

[75] Inventors: Daniel Dumas, Saint-Priest; Gérard Hudault, Saint-Jean-de-Maurienne, both of France

[73] Assignee: Societe des Electrodes et Refractaires Savoie, Paris, France

[22] Filed: July 7, 1976

[21] Appl. No.: 703,265

[30] Foreign Application Priority Data

July 17, 1975 France ..... 75.23065

[52] U.S. Cl. ..... 29/630 R; 29/527.1; 29/530; 204/280; 204/294

[51] Int. Cl.[2] ..... H01R 9/02

[58] Field of Search ..... 29/630 R, 628, 527.1, 29/527.5, 530; 204/280, 294; 174/68 B, 70 B, 71 B, 72 B

[56] References Cited

UNITED STATES PATENTS

| | | | |
|---|---|---|---|
| 1,957,940 | 5/1934 | Conradty | 204/294 X |
| 2,650,943 | 9/1953 | Leuchs et al. | 204/294 |
| 3,398,081 | 8/1968 | Bonfils et al. | 204/294 X |
| 3,517,434 | 6/1970 | Shaver | 29/527.1 X |
| 3,902,241 | 9/1975 | Wörner et al. | 29/527.1 X |

*Primary Examiner*—Victor A. DiPalma
*Attorney, Agent, or Firm*—Dennison, Dennison, Meserole & Pollack

[57] ABSTRACT

The invention concerns an improved method of interconnecting carbon blocks intended for the construction of cathodes in cells for electrolysis of aluminum and the steel bars which connect these blocks to the source of current. The method comprises forming the current supplying bars in two portions or half-bars which are housed in channels provided in the carbon blocks, the half-bars being rigidly connected to the blocks by bedding with cast iron or steel. One or more anchoring points provided near the end of the blocks holds the half-bars in position, while the ends of the bars near the middle of the blocks can expand freely in zones left for the purpose.

11 Claims, 3 Drawing Figures

METHOD OF MAKING CATHODES

This invention relates to cathodes employed in electrolysis of aluminum and more particularly concerns an improved form of connection between the metal supporting bars and the blocks of carbon constituting the cathodes.

The usual arrangement is for each carbon block to contain one or more open grooves or channels parallel with the length of the block. The channels are ordinarily substantially larger in section than the supporting steel bars to be accommodated in them. Thus, when the bars are correctly disposed within the channels, a gap of approximately 1 to 3 cm exists between the channel wall and the surface of the bar facing toward that wall. The gap is filled with a suitable material hereinafter described to provide a sound electrical and mechanical connection between the steel bars and the carbon blocks.

The cathode blocks equipped with their steel bars for supplying current must in fact be capable of being handled during the mounting of the electrolytic cells without danger of damage or inadvertent disassembly. The connecting material used in the gap is either carbon applied in the form of a paste or powder or more commonly cast iron or steel which is applied by casting. The cast metal is poured directly into the gap between the bar and the carbon block. This type of connection is relatively easy to form and provides good contact between the carbon blocks and the steel bars, even in cases where the bars are rough from hot rolling and have inaccurate dimensions and possibly faults of straightness. Once the cast metal has solidified, contact between it and the bar is excellent. On the other hand, a certain clearance has been created between the carbon block and the cast metal due to the shrinkage of the latter. When the electrolytic cell is put into service, the progressive heating of the cathode gradually leads to a decrease and even to elimination of the clearance and electrical contact between the bar and the block becomes excellent. If the block should crack during the life of the cell, any attack on the cast metal by the liquid aluminum will be far less rapid than the attack on the steel so that the life of the cell is extended.

These advantages have hitherto been reduced or even cancelled out by the premature appearance of cracks in the carbon blocks often initiated by the very operation of pouring cast metal into the gap between the steel bar and the carbon block. Crack systems have been observed in both longitudinal and/or transverse directions and in some instances, both systems of cracks may exist simultaneously in the same block.

Longitudinal cracks or V-shaped cracks are due to transverse pressure exerted on the walls of the groove by the steel bar covered with its sheath of cast metal. They may have been initiated at the time of casting, but they usually develop when the cell is heated. Under these conditions, the temperature of the steel bar rises rapidly by the Joule effect and since its coefficient of expansion is five times that of carbon, the bar exerts considerable pressure on the carbon walls of the channel. Since the material of the carbon blocks is incapable of any appreciable plastic deformation, a fracture is produced in the side walls of the channel. Fracture usually starts from the bottom of the channel and may spread over its entire length. Such fracture may effectivey destroy the block concerned. A possible way of overcoming this difficulty is for example to preheat both the steel bars and the carbon blocks before pouring the casting metal in the gap. Thus, when the metal has cooled, the steel bar sheathed in cast metal shrinks away from the carbon block and creates slight clearance between them. If the thermal parameters have been properly calculated, the clearance will be filled by expansion when the cell is heated without applying excessive strains on the walls of the channel in the carbon block.

Transverse cracks, like longitudinal ones, may have been initiated when the cast metal was poured in the gap, but in most instances, it has been found that they develop chiefly when the cell is being heated. Such cracks are also due to the fact that expansion of the steel bars sheathed in cast metal is five times greater in a longitudinal direction than that of the carbon blocks. Accordingly, if the frictional forces between the cast metal and the walls of the channel in the carbon block are too great, the steel bars cannot slide within the grooves and thus they exert tensile forces on the blocks which rapidly exceed the breaking load and lead to the formation of transverse cracks or crack systems. The dangers of cracking increase with an increase in the length of the carbon blocks and the greater the pressure exerted inside the cells on the side walls of the blocks producing considerable frictional forces. Thus, it may be seen that the pressure stems from the fact that the rigid metal body counteracts expansion of the carbon blocks in a direction perpendicular to their large side surfaces during the rise in the temperature of the cell.

The portions of the carbon blocks where the frictional forces are greatest are often toward the ends of the blocks since preheating conditions before the metal is poured in are often such that the bars are slightly cooler in these areas when the metal solidifies and there is consequently slightly less subsequent shrinkage. These disadvantages which have been known for a long time have gradually become more serious with increases in the length of cathode blocks.

There are various known ways of avoiding transverse cracking of carbon blocks during the casting of the metal. Thus French Pat. No. 2,175,657 proposes preheating the carbon blocks and steel bars under specific temperature conditions before the metal is cast. French Pat. No. 2,175,658 proposes that the carbon blocks should be compressed longitudinally during casting. These are examples of known techniques of avoiding any cracking during the casting of the metal in the gap, but they do not prevent subsequent cracking by the process just described above.

As a means of avoiding these unresolved difficulties, this invention utilizes the concept of deliberately creating fixed anchoring points for the steel bars within the channels in the carbon blocks and of taking the necessary measures to enable the bars covered with their metal sheath formed by casting to slide relatively freely from the anchoring points within the modified channels.

The anchoring areas selected are precisely the areas where frictional forces are greatest, that is to say, adjacent the two ends of each block. Taking these as the anchoring points and with the goal of enabling the bars to slide freely within the channels, it is now recognized that the cracking problem would be resolved by providing an interruption in the channel adjacent the center of the block to permit the use of half-bars capable of sliding from the anchoring point toward the center of the block. This technique eliminates the problem resulting from the differential expansion within the groove. It is also desirable that the compressive forces exerted transversely on the side walls of the channel by adjacent blocks would not interfere with the sliding movement in the middle region. With this in view, an additional feature of the invention is recognized in that it is possible to reinforce the structure of the blocks by interrupting the channel over an adequate area adjacent the middle of the block. The presence of such a solid interruption zone in the channel prevents any inward deformation or fracturing of the side walls of the channel in the carbon blocks in the vicinity of the middle zone and thus greatly reduces deformation of the walls of the grooved zones throughout the length of the blocks. The extent of the interrupted zone may vary according to the length of the blocks and the general design of the tank. In the case of blocks approximately 3 to 4 meters long, it is helpful to provide an interrupted channel zone extending over a length of about 100 to 500 mm and located generally in the middle of the blocks. In all cases, however, the ends of the half-bars located near the middle of the blocks must be able to become longer or shorter freely without applying significant strain forces to the walls of the channel.

When discontinuous channels are employed, there must, in the cold state, be a space available for expansion between the ends of the half-bars and the walls which interrupt the channel in the middle zone. In those cases where the channel is continuous (not shown) from one end of the block to the other, there must, in the cold state, be an expansion zone within each groove near the center of each block and between the ends of the opposed half-bars. The expansion zone must be long enough to allow maximum lengthwise expansion of the half-bars to take place freely without the bars applying significant strain forces on the walls of the channel or coming into contact with one another. In the case of a steel bar housed within a two meter long channel in a block of carbon, where the unit is brought to about 900° C, differential elongation can be calculated to be about 20 mm. An expansion zone of about 20 mm or more is therefore required within the channel for expansion of each half-bar near the middle of the blocks. Thus, a space of 40 mm or more is required in the case of a continuous channel. To prevent the space from being filled with cast iron or steel when the metal is poured in, an impervious seal made for example of asbestos may be placed near the end of the half-bar toward the middle of the block so that the seal fills the gap between the half-bar and the end walls of the channel. Obviously, seals may be placed near the ends of the blocks to prevent the cast metal from flowing out of the gap.

The anchoring point or points made on each half-bar near the end of the blocks may be formed in several ways without going beyond the scope of the invention. In one technique, for example, one or more recesses of the desired section and depth may be formed in one or more wall of the channel walls with a suitable tool. The recesses may be machined with appropriate drills or milling cutters. Their depth and cross-section must be such that, after casting and cooling of the metal, the reliefs thus created on the metal sheath of the bar cannot become displaced from the recess in the carbon blocks for example due to shrinkage following solidification and cooling. The cross-section of the recesses must also be sufficient to make the reliefs resistant without cracking to the shearing stresses which will be created when the blocks are handled and by the normal expanding forces when the cell is being heated. Generally speaking, it is sufficient for the holes to have a depth of about 10 to 50 mm. To facilitate machining, the walls of the recesses are generally not cylindrical, but tend to converge inwardly. They may also have rounded portions near the bottom and near the outer edge. This allows the cast metal to enter easily and provide the reliefs without sharp angles. Thus the reliefs anchor the half-bars perfectly thereby minimizing any possible tendency toward sliding. The recesses are formed a short distance inwardly from the ends of the blocks and displaced from the ends of the channel wall, thus avoiding the risk of cracking the channel walls. The recesses are preferably formed about 50 to 200 mm away from the ends of the block. As an alternative to recesses, one or more vertical or transverse slots of any appropriate profile and length may be formed in the side walls of the channels or as an alternative, reliefs of preselected shape and dimensions may be formed on the walls of the grooves. Such reliefs can be obtained very simply by limiting machining to the places where they are required to appear. This technique avoids even localized weakening of the carbon blocks.

To reduce the possibility that the ends of the half-bars located toward the center of the blocks may disengage from the channel, particularly during handling for assembly, it is considered desirable to provide at least a section of the channel with a profile such that the bars cannot be inadvertently displaced from the channel by a force perpendicular to the plane of the channel surface of the block and therefore limit movement of the half-bars to sliding motion within the channels.

The use of profiles for this purpose is well known in the art. Thus, channels of dovetail or diabolo shape are employed. Such channels have a narrow "waist" zone approximately halfway down. Thus, when the metal is cast, it takes on the general shape of the channel and when it has solidified and shrunk, the bar sheathed in it can no longer be pulled out of the channel without breaking the side walls thereof. On the other hand, the non-anchored end will be able to slide back and forth freely within the channel in response to variations in temperature.

The invention may also be applied to application where the half-bars are placed in holes extending into the carbon blocks, the half-bars being inserted in the blocks from the end faces thereof.

If desired, one or more such holes may open onto each end face. The hole or holes are formed substantially parallel with the length of the block and may extend through the block from one end to the other. Alternatively, they may be interrupted near the middle of the block in order to maintain maximum resistance to mechanical strains in that zone. Although the holes may be of any cross-section, it is usually convenient to make them circular. The half-bars which are placed inside are also of any cross-section, usually circular or parallelepipedal. There must, of course, be sufficient clearance between the bar and the hole to enable the metal to be cast. The clearance is of the same order as that envisaged for when the half-bars are housed in channels. The half-bars are anchored near each end of the blocks in the same manner as in the channelled configuration by the use of one or more depressions or reliefs within or on the walls of the holes. Such depressions or reliefs are preferably positioned about 50 to 200 mm from the end of the block. The depressions or reliefs may for example have an annular shape in the case of cylindrical holes. As in the case of channels, an expansion area is provided for expansion of the half-bars and such area is of the order of 20 mm or more for each half-bar. The cast metal can be prevented from flowing into the expansion zones by impervious seals made for example of asbestos, or other suitable material, in a way quite comparable to the method used when the metal is cast into the channel. As a final alternative, the spaces left free for the expansion of the half-bars in or near the middle zones of the blocks may be filled with a compressible substance such as natural graphite powder or a carbon felt.

The invention will be more easily understood by reference to the accompanying drawings taken in connection with the following description of a preferred embodiment of the invention.

Figure 1:
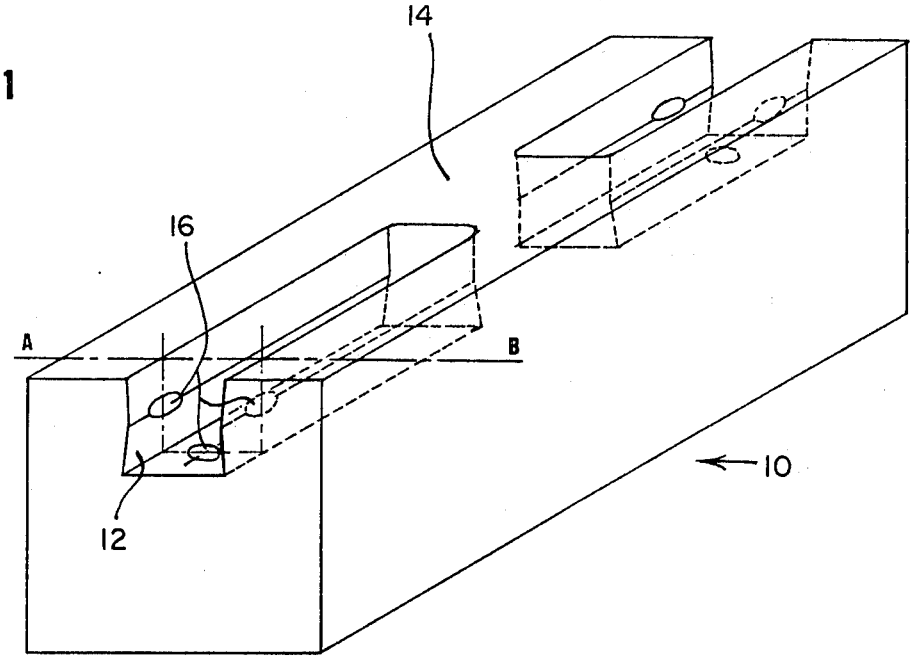
FIG. 1 is a perspective view of one of the carbon blocks.
Figure 2:
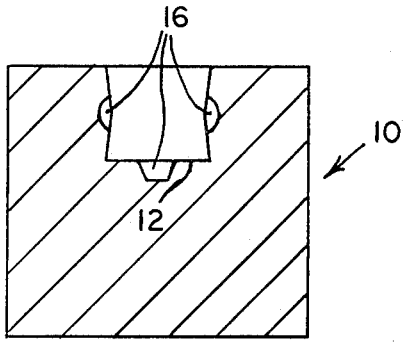
FIG. 2 is a cross-section of the block of FIG. 1 taken along the lines A–B of FIG. 1.

Referring now to FIG. 1, blocks 10 of amorphous carbon intended for the construction of both cathodes for electrolysis of aluminum are made by methods known in the art in the form of parallelepipeds 500 × 450 × 3200 mm. In each block, a diabolo-shaped channel 12 is formed along the longitudinal axis of one of the surfaces and is approximately 500 mm wide. In one example, the cross-section of the channel utilized the following dimensions: depth 155 mm, width at inlet and at bottom 170 mm, width halfway down 160 mm. In the middle in the illustrated form of the block, the channel is interrupted over a length of approximately 300 mm by a transverse wall 14. Three blind recesses 16, 30 mm deep, are bored in the walls of the channel approximately 100 mm from each end of the block. The recess drilled in the bottom of the channel, along its axis, has a generally tapered cross-section with a diameter at the inlet of 60 mm and a diameter of 30 mm at the bottom.

The recesses in the side walls are bored one opposite the other approximately halfway up the side walls of the channel. The recesses are approximately 20 mm deep and preferably have rounded edges. Because of the shape of the cutting tool (not shown), the recess height at the inlet is about 60 mm and the width measured parallel with the length of the channel is about 90 mm.

Figure 3:
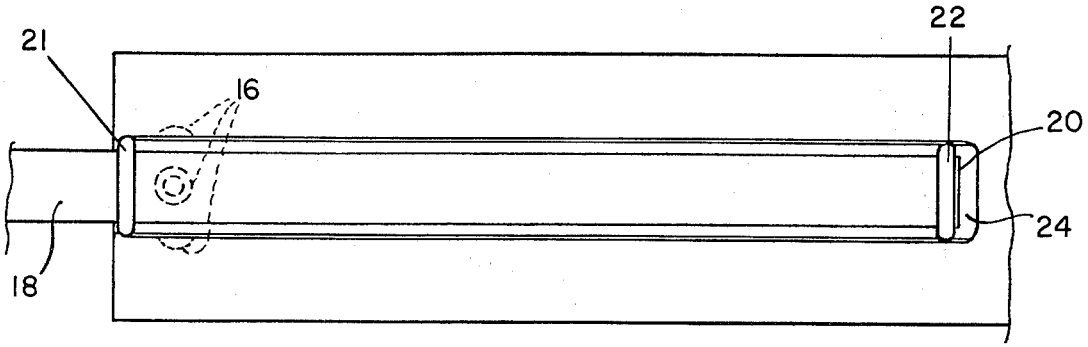
FIG. 3 is a fragmentary top plan view of a portion of the carbon block with one half-bar in position.

A half-bar 18 approximately 120 × 140 mm in section is disposed within the channel (FIG. 3) in the block 10 with its upper surface substantially level with the surface of the block and so that the end 20 of the bar toward the middle of the block 10 has a longitudinal clearance of about 30 mm relative to the end wall of the channel defined by the transverse wall 14 near the middle of the block 10. Two asbestos seals 21, 22 are mounted on the half-bar and extend into the gap between the bar and the wall of the channel with one seal 21 at the inlet of the channel near the end of the block and the other seal 22 at the end of the half-bar toward the middle of the block. The seals are thus positioned to prevent the metal which will be cast into the gap from invading the space 24 of 30 mm or from flowing away externally. The usual methods well known in the art are applied in preparing the blocks and bars in preheating them prior to casting and in the casting process itself.

After casting the gap metal and cooling, it is possible to handle the resultant assemblies without special precautions and they are particularly easy to position when mounting the cathodes in electrolytic cells.

The half-bars 18 may be anchored at the ends of the blocks by means of one or more recesses or slots 16 which may be formed in any shape suitable to prevent the bars 18 from sliding in a direction parallel with the axis of the blocks of carbon. Alternatively, the carbon blocks may contain one or more continuous channels extending from one end of the block to the other or they may utilize a transverse wall zone near the center as illustrated. In the latter case, the expansion gap 24 is left between the end 20 of the half-bar 18 and the center end of the channel. Finally, it is preferable although not indispensable to give the cross-section of the channel a shape such that the half-bars cannot be inadvertently displaced by a transverse force. Any shape, of any degree of complexity may be envisaged to obtain this result. Although the bar shown in the drawing is parallelepipedal in section, it is contemplated that bars of many shapes may be envisaged without going beyond the scope of the invention. Bars of circular cross-section in particular may give excellent results.

When the channels are continuous, a form not illustrated in the drawings, the half-bars must be able to expand freely without displacement being prevented by possible contact with each other. If current distribution requirements make it desirable, the ends of the half-bars can conceivably be cut so that they can slide over the necessary length of one another in the middle region. This can be done by cutting each over half the cross-section. In that configuration, the gap metal being cast must not enter the zone of overlap. However, electrical contact can be established if the space not filled with cast metal is filled with a compressible conductive substance such as powdered natural graphite or a carbon felt.

Similar arrangements may also be made in cases where instead of containing continuous channels, the blocks contain bores extending through them with the half-bars housed within the bores as described above.

It is further contemplated that in those cases where the blocks have channels with transverse walls at the central portion, the expansion spaces left free at the end of the bars may equally be filled with a compressible substance such as powdered graphite or a carbon felt.

The foregoing is considered as illustrative only of the principles of the invention. Since numerous modifications and alternative constructions will readily occur to those familiar with the art, it is not desired to limit the invention to the exact construction shown and described and accordingly, all suitable modifications and equivalents are contemplated which fall within the scope of the appended claims.

We claim:

1. The method of making a cathode element for an electrolytic cell wherein current supplying steel bars are joined to blocks of carbon consisting of the steps of forming an elongated carbon block with means defining a channel extending along at least a major portion of its length, positioning at least one steel bar in spaced relation within and extending substantially the length of said channel and securing the same therewithin for sliding movement along a line generally parallel to the longitudinal axis of said block, anchoring said bar within said channel at at least one anchoring point to preclude transverse displacement of said bar with respect to said channel, and filling selected portions of the space between said channel and said bar with a cast material while maintaining an expansion zone adjacent a different preselected portion of said bar to permit longitudinal expansion of said bar within said channel in response to variation in a temperature condition.

2. The method of claim 1 wherein the channel is interrupted adjacent the mid-portion of each block by a transverse wall.

3. The method of claim 1 wherein the expansion zone for expansion of the bar is filled with a compressible material.

4. The method of claim 1 wherein said compressible material is carbon felt.

5. The method of claim 1 wherein said compressible material is powdered graphite.

6. The method of claim 1 wherein said cast material is cast metal.

7. The method of claim 1 wherein said cast material is cast iron.

8. The method of claim 1 wherein said channel is of parallelepipedal shape in cross-section.

9. The method of claim 1 wherein anchor means including at least one recess is formed in a wall of said channel and said recess is filled with said cast material.

10. The method of claim 1 wherein said cast material is confined to a zone defined by at least one seal member.

11. The method of claim 1 wherein a first seal member is mounted on said bar adjacent said expansion zone and a second seal member is mounted on said bar adjacent one end of said block.

* * * * *